US005181486A

United States Patent [19]

Gyurovits

[11] Patent Number: 5,181,486

[45] Date of Patent: Jan. 26, 1993

[54] TIMING-RANGE GEAR

[76] Inventor: John S. Gyurovits, 2256 Brookside Dr., Martinsville, N.J. 08836-9659

[21] Appl. No.: 945,370

[22] Filed: Sep. 16, 1992

Related U.S. Application Data

[63] Continuation-in-part of Ser. No. 721,400, Jun. 26, 1991.

[51] Int. Cl.[5] ..... F01L 1/34

[52] U.S. Cl. ..... 123/90.17; 123/90.31; 123/501; 464/1; 74/567; 74/568 R

[58] Field of Search ..... 123/90.15, 90.17, 90.31, 123/500, 501, 503; 464/1, 2, 160; 74/567, 568 R

[56] References Cited

U.S. PATENT DOCUMENTS

| | | | |
|---|---|---|---|
| 1,105,628 | 8/1914 | Diemer | 464/1 |
| 1,304,768 | 5/1919 | Henderson | 464/1 |
| 1,957,181 | 5/1934 | Mitchel | 464/1 |
| 1,999,364 | 4/1935 | Lang | 464/1 |
| 2,740,273 | 4/1956 | Ziesche et al. | 464/1 |
| 3,008,313 | 11/1961 | Mehlitz | 464/1 |
| 3,455,286 | 7/1969 | Reisacher | 464/1 |
| 3,650,125 | 3/1972 | Phillips | 464/1 |
| 4,548,182 | 10/1985 | Kamleitner | 123/501 |
| 4,577,598 | 3/1986 | Ma | 123/90.15 |

FOREIGN PATENT DOCUMENTS

| | | | |
|---|---|---|---|
| 149708 | 6/1990 | Japan | 123/90.17 |
| 727868 | 4/1980 | U.S.S.R. | 464/1 |
| 1316117 | 5/1973 | United Kingdom | 464/1 |
| 2200973 | 8/1988 | United Kingdom | 464/1 |

*Primary Examiner*—E. Rollins Cross
*Assistant Examiner*—Weilun Lo

[57] ABSTRACT

A centrifugal force governed mechanism for continuously controlling valve timing events of internal combustion engines. An outer-hub being coaxially interfaced in a journally oscillating relationship with an inner-hub and through a center bore, longitudinally mounted onto the camshaft and synchronously driven by the crankshaft. A plurality of parallel sided cavities radially placed within one side of the inner-hub and leading outward through the journaling periphery thereof into each counterpart within the outer-hub. A guided sliding weight within each cavity of the inner-hub provides the phasing control between the inner and outer-hub members. When the centrifugal force overcomes the camshaft torque and tension of the return-spring, each weight is expelled radially outward into each correspondingly placed cavity within the outer-hub. In an alternate embodiment, the centrifugal force and camshaft torque together overcome the return-spring tension. The phasing ramp of the cavity within the outer-hub and the opposite guiding side of each corresponding cavity within the inner-hub, cooperatively with said weights, change the phased angular relationship between the camshaft and the crankshaft.

14 Claims, 2 Drawing Sheets

TIMING-RANGE GEAR

This application is a "CONTINUATION-IN-PART" of an earlier application Ser. No. 07/721,400, filed Jun. 26, 1991, titled Timing-Range Gear.

BACKGROUND OF THE INVENTION

1. Field of the Invention

This invention relates generally to valve timing varying devices which are used for advancing and/or retarding the phased camshaft to crankshaft relationship in internal combustion (I.C.) engines during operation.

2. Description of the Related Art

State of the art valve timing-varying devices which are used primarily for automotive I.C. engines are either very complex in nature or made up of components that are short lived or beset with operational problems. These devices are generally a hybrid of complex electro-mechanical or hydro-mechanical systems which by their character depend on component-dense electronic subsystems for precisely controlling the phased camshaft to crankshaft position on demand. While they improve engine performance and provide more economical vehicle operation, the advantages gained are offset by the costs of system failures and maintenance. Mechanisms disclosed in U.S. Pat. No. 3,978,829 to Takahashi, and U.S. Pat. Nos. 4,494,495, 4,494,496 and 4,561,390 to Nakamura et al. are highly complex self-adjusting gear means and heavily dependent on component-dense subsystems for operation. They are costly to manufacture and to maintain in reliable operating condition. Along with the needed electronic signal generating sensors, signal processing computers and other related controls, they are also excessively bulky and their substantially overhanging size tends to expand the engine's overall length. Also, U.S. Pat. No. 4,754,727 to Hampton besides being dependent on complex automotive electronics, this system is beset by problems generally associated with rotating electro-mechanical systems which operate in extremely hostile environments. In hydro-mechanical arts which are disclosed in U.S. Pat. Nos. 4,627,825 to Bruss et al., 4,535,731 to Banfi, and 4,787,345 to Thoma, their overall functional reliability is greatly reduced by their complex electronic controls and costly hydraulically operated components. Yet in other arts comprising spherical or cylindrical flyweights to accomplish angular changes, these devices are plagued with problems associated with high unit loads being concentrated on relatively small sliding surfaces which directly effect the system's operating life cycle and functional reliability U.S. Pat. No. 5,090,365 to Hotta et al. includes mated labyrinth grooves on component surfaces as hydraulic dampers and integrated electronic control systems which require costly maintenance In an all hydraulically operated device as disclosed in U.S. Pat. 4,858,572 to Shirai et al., the actuating vanes lack the positive seals which are necessary for precisely maintaining angular position under all operating conditions. The above referred systems are excessively costly to manufacture, expensive to maintain, and by their character have only marginal system reliability.

OBJECTS AND SUMMARY OF THE INVENTION

The primary object of the invention is to provide a timing-range gear means which will readily interface with existing internal combustion engine components and cooperatively advance or retard the phased camshaft to crankshaft relationship with respect to the direction of rotation.

It is also the object of the invention to provide a simply constructed and highly reliable timing-range gear device for retrofitting older model as well as current model internal combustion engines to improve the performance of the engines thereby reducing noxious exhaust emissions while improving fuel economy to the benefit of mankind.

It is also the object of the invention to provide a timing-range gear means for internal as well as for external drive installations as an original equipment manufacture (OEM) component or as an after-market replacement engine part.

The device of the present invention is the product of advanced engineering science, production related economic factors and environmental considerations. It is a simple and cost-effective construction yet functionally it is a highly reliable device. It is well suited for OEM use or as an optional part for converting new or after-market I.C. engines from a fixedpoint camshaft to crankshaft phase into an active phase-range for improving engine performance.

The present invention is a centrifugal force governed device that reacts to changes in engine speeds and automatically converts the speed changes to angular motion, either advancing or retarding the valve timing with respect to the original camshaft to crankshaft phase. Inherent in its simple construction are the advantages not available in component dense devices of the prior art, particularly those relying on complex electronic or other types of integrated control systems for operation. Its unattached, independently moving, actuating weights provide high functional reliability and instantaneous reaction to engine speed changes.

Through a center bore, the device is longitudinally mounted onto the camshaft and is in a phased relationship with the driving crankshaft. Its outer-hub has a large circular cavity on one side in connection with a plurality of smaller radial cavities, and one side of each radial cavity is a phasing ramp. The inner-hub has a journal on one side and a plurality of parallel sided cavities through its periphery that correspond to each radial cavity in the outer-hub member. A sliding weight in each parallel sided cavity interacts with the phasing ramp and causes the inner-hub to journally shift its phased relation with respect to the driven outer-hub member. The tension of the return spring cause each weight to retract into its cavity within the inner-hub.

Other objects and advantages which are peculiar to the Timing-Range Gear means of the invention will become readily apparent, and can best be understood by examining the following descriptions in conjunction with the accompanying reference drawings.

DESCRIPTION OF THE PREFERRED EMBODIMENTS

Figure 2:
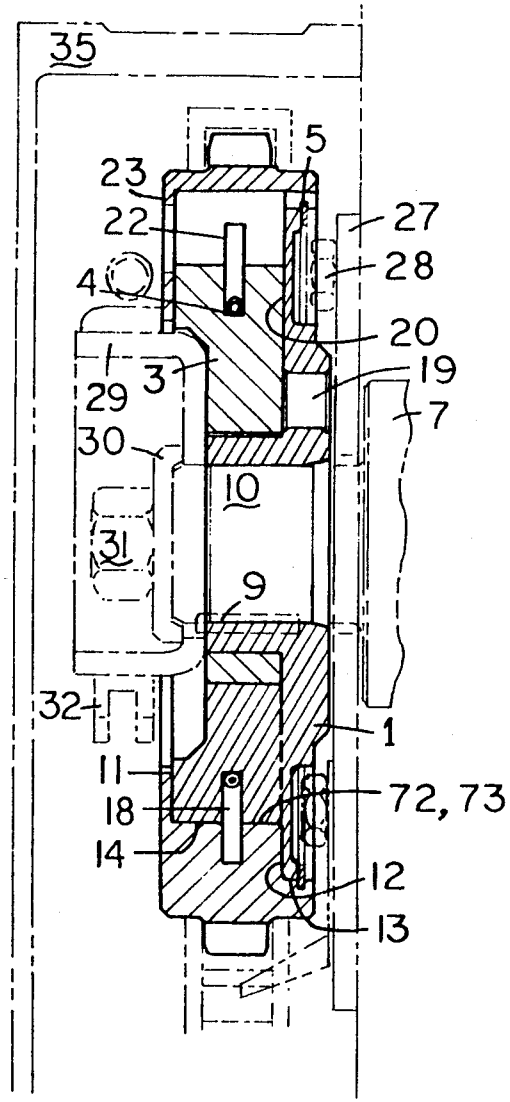
FIG. 2 of sheet 1, is a side elevational cross section taken along the line 1—1 of FIG. 1.
Figure 1:
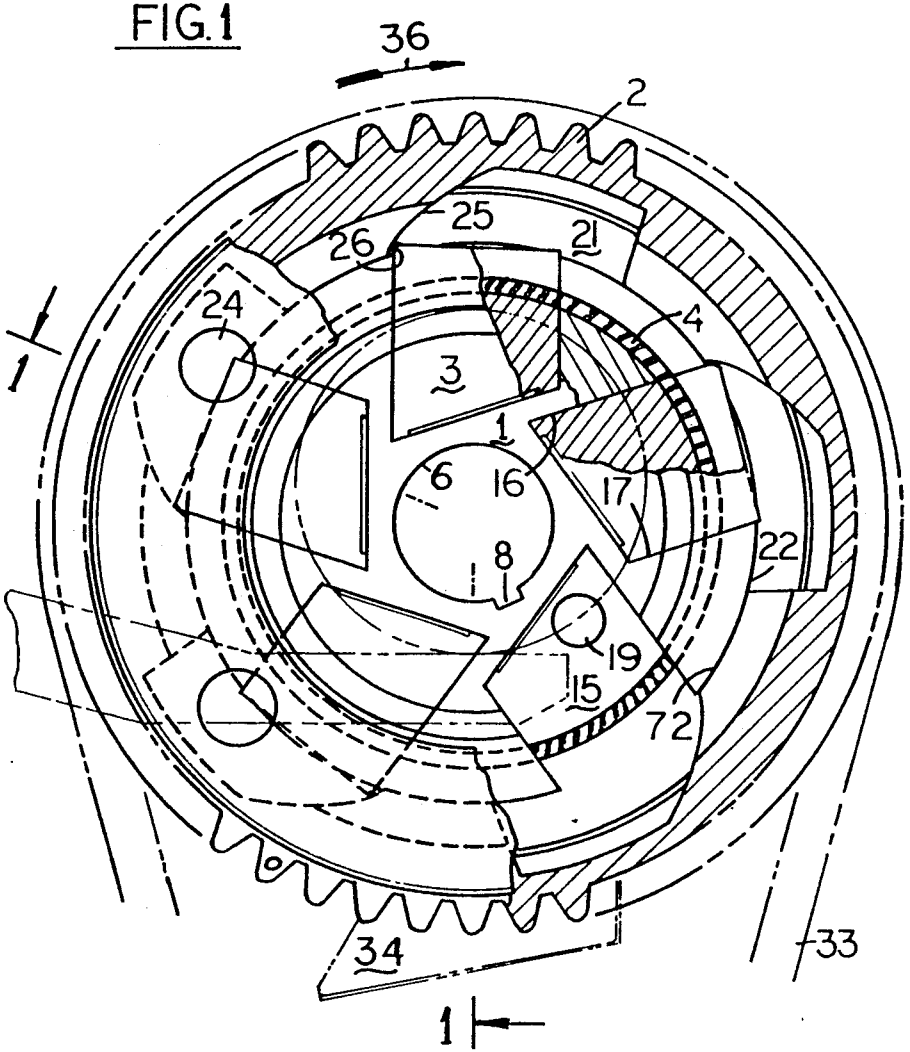
FIG. 1 of sheet 1, is a partially exploded plan view illustrating the relationship of the internal components in a normally closed position of a phase-advancing gear means.

The device disclosed in the following specifications and accompanying drawings is comprised of: an inner hub 1, an outer sprocket or a pulley 2, a plurality of flyweights 3, an annular spring 4 and a retainer ring 5 The inner hub 1 is journally oscillating between the limits of travel within the outer sprocket 2. The inner hub 1 has a bore 6 longitudinally placed through its center and removably mounted on to an end 10 of an existing camshaft 7 shown in phantom lines in FIG. 2. A key way 8 is extending longitudinally in the periphery of the bore 6 and provides a fixed angular position between the hub 1 and the camshaft 7 through a key 9 that is correspondingly located in the camshaft end 10. A first planar mating surface 11 is parallel to a second planar mating surface 12 of a flange 13, and each of the planar surfaces are substantially perpendicular to a circular load-bearing periphery 14. A plurality of cavities 15 are located through the first planar mating surface 11, and each of the cavities extends radially outward through the circular load-bearing periphery 14 and to the flange 13. In each of the cavities 15, one of the flyweights 3 is slideably fitted between a first side 16 and a second side 17. A circumferential groove 18 is cut into the circular load-bearing periphery 14, into the top of each of the flyweights 3 and into a corresponding journaling surface 72 of a circular central cavity 73 to receive the annular spring 4. A hole 19, through a back wall 20 of each of the cavities 15, provides means for lubrication. Each cavity 21 extends outward from a circular central cavity 73 of the outer sprocket 2. A flange 23 of the outer sprocket 2 has one of a plurality of holes 24 leading into each corresponding cavity 21. A phasing ramp 25 of the cavity 21, interacting with a rounded corner 26 of the flyweight 3, provides a rotational interlock between the hub 1 and the outer sprocket 2 during low engine speeds. A centrifugal force of sufficient magnitude causes the flyweight 3 to radially slide out from the cavity 15 of the hub 1 and progressively into the cavity 21 of the outer sprocket 2 against the force of the annular spring 4. Each of the flyweights 3, guided by the walls 16 and 17 of the cavity 15 and the phasing ramp 25, forces the hub 1 forward in a direction of rotation against the camshaft torque. The radial outward movement of the flyweights 3 causes the annular spring 4 to expand from the groove 18 of the hub member 1 into a groove 22 of the outer sprocket 2. When the centrifugal force is absent, the annular spring 4 keeps each flyweight 3 fully retracted in the cavity 15 of the hub 1. The device, as illustrated in FIGS. 1 and 2, is capable of being interfaced with the following existing engine components as shown by phantom lines in FIGS. 1 and 2: a retainer plate 27, screws 28, an eccentric cup 29, a retainer cup 30, a camshaft screw 31, a fuel pump arm 32, a chain or a belt 33, an oil splash plate 34 and a timing case cover 35. An arrow 36 indicates direction of rotation of the device.

Figure 6:
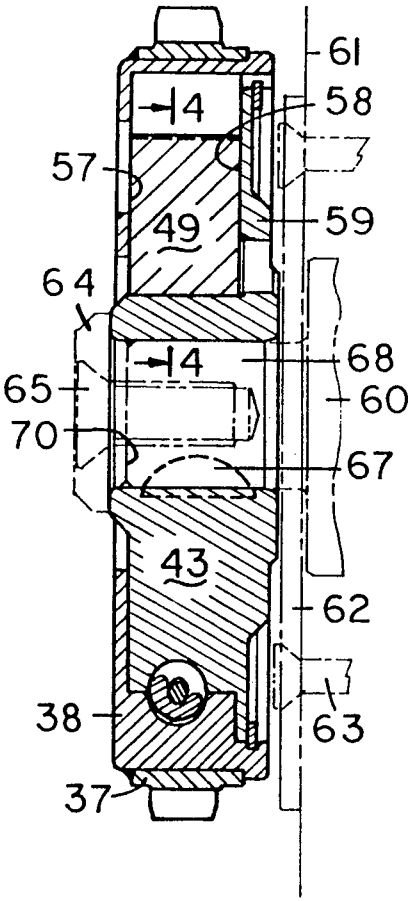
FIG. 6 of sheet 2, is a side elevational cross sectional view taken at line 2—2 of FIG. 3.
Figure 4:
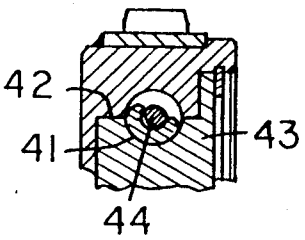
FIG. 4 of sheet 2, is a side elevational cross section taken along the line 3—3 of FIG. 3.
Figure 5:
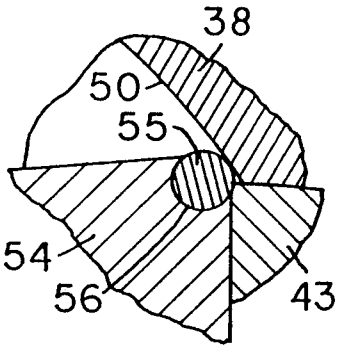
FIG. 5 of sheet 2, is a cross sectional view taken along the line 4—4 of FIG. 6 illustrating an alternate configuration of the flyweight.
Figure 3:
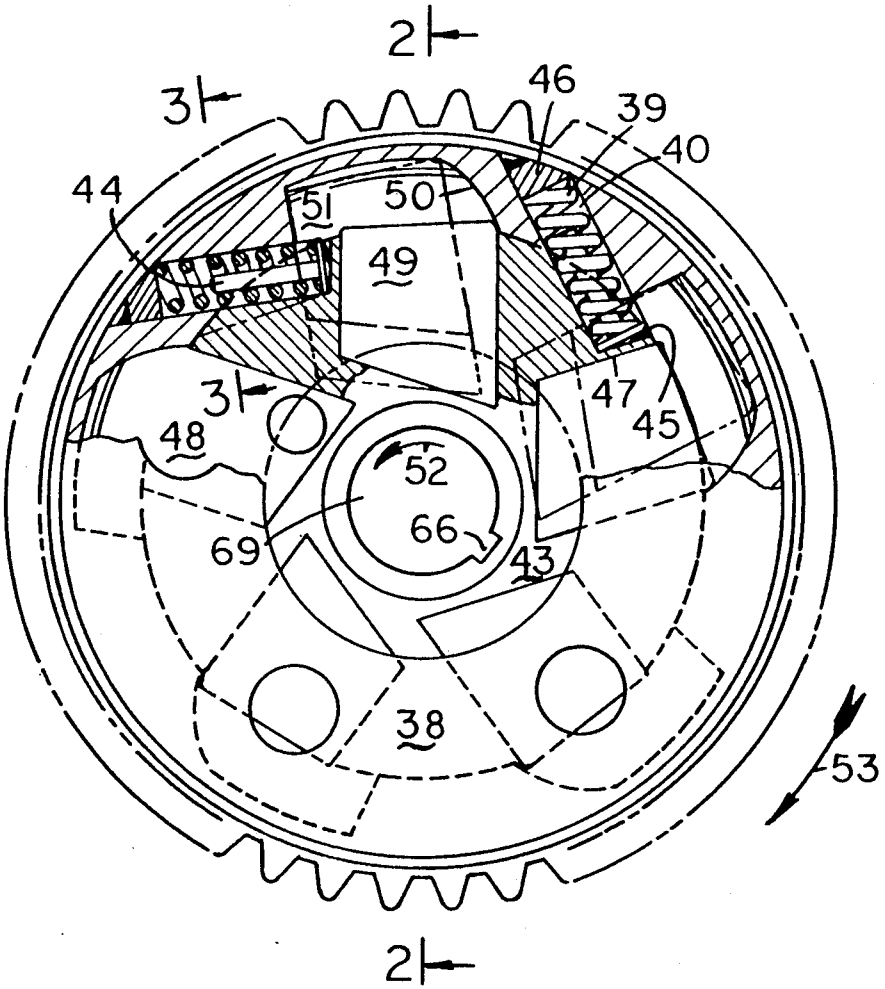
FIG. 3 of sheet 2, is a partially exploded plan view illustrating the relationship of the internal components in a normally closed position of a phase-retarding gear means of an alternate embodiment.

The device is illustrated in alternate embodiments by FIGS. 3 thru 6 of sheet 2 of 2. A toothed ring-gear or a pulley 37 is fixedly attached onto an outer-hub 38 A plurality of return springs 39, each spring being disposed in one of a plurality of cylindrical cavities 40. The cavities 40 in the outer-hub 38 are partially open on one end, and each is matingly opposed to a corresponding half-round cavity 41 in a load-bearing periphery 42 of an inner-hub 43 and a journaling surface 42 of the outer-hub 38 as shown in FIGS. 3, 4 and 6. A buttonhead rod 44 provides axial stability for a respective return spring 39 while in working compression between a flat bottom 45 of the half-round cavity 41 and a plug 46. The cavity 40 is placed substantially perpendicular to a pressure side 47 of a cavity 48 in the inner-hub 43 in which a flyweight 49 slideably interfaces a phasing ramp 50 of a cavity 51 in the outer-hub 38. When a centrifugal force acts upon the flyweights 49 and overcomes a camshaft torque and a tension of the return springs 39, the flyweights in the cavities 48 and the pressure side 47 coacting with the phasing ramp 50 alter a phased angular relationship between the outer-hub 38 and the inner-hub 43. Thus the inner-hub 43 shifts position in a direction of arrow 52 counter to a direction of drive indicated by arrow 53. In an alternate configuration as illustrated in FIG. 5, a flyweight 54 has a cylindrical roller 55 longitudinally disposed in a partially open sided cavity 56 of the flyweight 54 between an inner wall 57 of the outer-hub 38 and an inner wall 58 of a flange 59. The cylindrical roller 55 provides a rolling action against the phasing ramp 50.

The device, as illustrated in FIG. 6, is being interfaced with existing engine components which are shown in phantom lines. A camshaft 60 is rotatably held in a cylinder block 61 by a retainer plate 62 and a plurality of screws 63. A bore 69 of the hub 43 has a keyway 66 engaging a key 67 and a journal 68. A plate 64 is secured against an end 70 by a screw 65 and thus maintains the device in an axially secured and in a phased relation with the camshaft 60.

From the foregoing detailed description and accompanying drawings, it is evident that this invention is well adapted to attain all the ends and objects hereinabove set forth together with other advantages which are directly attributed to the valve Timing-Range Gear and to those which are the derived extensions thereof.

It is therefore to be understood that certain features and combinations of selected features and/or various sub-combinations derived therefrom may be employed by those skilled in the art to produce yet another new feature or group of new features without reference thereto and this is contemplated by and is within the scope and spirit of the invention and claims.

Since it is possible to produce derivative embodiments in various combinations from extensions of features without deviating from the scope and spirit of the invention therefore, it is to be understood that all matters described and made reference thereto in the foregoing description and specification are part of the legal equivalent of the following claims and not to be construed as limitations of the scope and spirit of the invention.

The disclosed embodiments, the scope and spirit of the invention for which an exclusive property or privilege is claimed are defined as follows:

I claim:

1. A centrifugal force governed valve timing device used as a compact integral part of an internal combustion engine for adjusting at least one of an advancing and a retarding of a relative angular position of a driven camshaft with respect to an angular position of a driving crankshaft, the camshaft having a central longitudinal axis, said device includes a camshaft drive means comprising:

an inner-hub member having an axial bore for removably interfacing the camshaft, a first circular cavity coaxial to said bore extending inward from a first planar mating surface for receiving existing engine components, a circular load-bearing periphery, a flange extending outward form said circular load-bearing periphery and having a second planar mating surface, and a first radial cavity means extending from said first planar mating surface to said second planar mating surface and extending radially inward from said circular load-bearing periphery for receiving and coaperatively interacting with a slidable flyweight means;

an outer-hub member, in a phased relation to a crankshaft, having a circular central cavity with a journaling surface ending at a flat-bottom thereof for slidably receiving and rotatably interacitng with said inner-hub member through said first and second planar surfaces and said circular load-bearing periphery thereof, and having a second radial cavity means extending radially outward from the journaling surface;

said slidable flyweight means includes at least one member, each said member including a phasing portion, said phasing portion including a rounded corner, said rounded corner engaging a corresponding phasing surface of the second radial cavity means of said outer-hub member, wherein a sliding action of the slidable flyweight means is translated into angular displacement between said inner-hub and outer-hub members;

and a spring means disposed to interact with said slidable flyweight means.

2. The device as claimed in claim 1, wherein the inner-hub member including the circular load-bearing periphery being coaxial to the longitudinal axis, said first planar surface being substantially perpendicular to the longitudinal axis, said second planar surface being substantially parallel to said first planar surface and extending outward from said load-bearing periphery, a circumferential groove in said load-bearing periphery, an outside planar surface opposite said first planar surface and having a second circular flat-bottom cavity leading inwardly therefrom for providing a clearance for existing engine components, a coaxial flat-bottom cavity centrally placed in said first planar surface to interface existing engine components, and a central bore therethrough coaxial to the longitudinal axis to receive a camshaft end;

the outer-hub member having a flange for a frontal planar side which has a central bore therethrough, a circular shallow cavity centrally placed and leading inward from a side opposite to said frontal planar side, said circular central cavity is coaxial to said shallow cavity and leading inwardly therefrom and ending at an inner planar surface, said second radial cavity means of the outer-hub member is in matching communication with said first radial cavity means of said inner-hub member, and a groove in said journaling surface being in communication with said circumferential groove of said load-bearing periphery of the inner-hub member;

the slidable flyweight means including at least two phasing flyweights, each said flyweight having a groove being in alignment with the grooves of said inner-hub and outer-hub member; and said spring means including at least one annular spring means disposed in communication with said grooves of said phasing flyweights and said inner-hub and outer-hub members.

3. The device as claimed in claim 2, wherein the phasing flyweights include sliding surfaces thereof matchingly conforming to said second surface of said inner-hub member and the inner-planar surface of said circular central cavity of said outer-hub member.

4. The device as claimed in claim 2, wherein the annular spring means becomes disposed in said circumferential groove of said inner-hub member and said groove of said phasing flyweights in an absence of a centrifugal force of sufficient magnitude which causes a retraction of said phasing flyweights to the bottom of said cavities within said inner-hub member.

5. The device as claimed in claim 1, wherein the surface of said circular load-bearing periphery of the inner-hub member and the journaling surface of the outer-hub member being oscillatingly interlocked by said phasing fly-weights, and a cylindrical cavity means, to receive said spring means including cylindrical return springs, extending from an outer periphery of said outer-hub member through both the journaling surface of the outer-hub member and the surface of the load-bearing periphery of said inner-hub member and ending in a flat bottom in close proximity to the first radial cavity means within said inner-hub member.

6. The device as claimed in claim 5, Wherein a guide means including a stem and a convex head is disposed in said spring means to provide axial stability during phasing action, and the head of said guide means engages the flat bottom of the cylindrical cavity means in the inner-hub member.

7. The device as claimed in claim 5, wherein the spring means is in axial compression within said cylindrical cavity means.

8. The device as claimed in claim 5, wherein said cylindrical cavity means comprises a plurality of aligned cavity means, and each said aligned cavity means includes a first cavity portion in said inner-hub member and a second cavity portion in said outer-hub member.

9. The device as claimed in claim 8, wherein said flat bottom of the cylindrical cavity means is in said first cavity portion defining a first end of said aligned cavity means, and a plug means in said second cavity portion defines a second end of said aligned cavity means, said plug means being fixedly attached to a portion adjacent the outer periphery of said outer-hub member.

10. The device as claimed in claim 1, wherein the slidable flyweight means has a partially open circular cavity at the phasing portion to receive a roller means.

11. The device as claimed in claim 10, wherein the roller means engages a phasing ramp means of said second radial cavity means of said outer-hub member to provide a low-friction rolling action therein between.

12. The device as claimed in claim 1, wherein the first planar surface of the inner-hub member and the inner planar surface of the circular central cavity of the outer-hub member are coplanar.

13. The device as claimed in claim 1, wherein an outer side of said flange of said inner-hub member cooperatingly interfaces existing engine components within close proximity thereto.

14. The device as claimed in claim 1, wherein said drive means further comprising one of an outer-ring gear means and an outer-ring pulley means having a central bore coaxial to the longitudinal axis and fixedly interfaced with an outer periphery of said outer-hub member and in phased relation with said driven camshaft.

* * * * *